US008394259B2

(12) United States Patent
Palmas et al.

(10) Patent No.: US 8,394,259 B2
(45) Date of Patent: Mar. 12, 2013

(54) UNIT, SYSTEM AND PROCESS FOR CATALYTIC CRACKING

(75) Inventors: Paolo Palmas, Des Plaines, IL (US); Robert L. Mehlberg, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 13/368,719

(22) Filed: Feb. 8, 2012

(65) Prior Publication Data

US 2012/0136187 A1 May 31, 2012

Related U.S. Application Data

(62) Division of application No. 12/333,262, filed on Dec. 11, 2008, now Pat. No. 8,137,631.

(51) Int. Cl.
*C10G 51/04* (2006.01)

(52) U.S. Cl. ..... 208/74; 208/72; 208/73; 208/77; 208/78

(58) Field of Classification Search ..... 208/67, 208/72–74, 76, 77
See application file for complete search history.

(56) References Cited

U.S. PATENT DOCUMENTS 3,928,172 A * 12/1975 Davis et al. ..... 208/77
4,310,489 A * 1/1982 Fahrig et al. ..... 422/110

* cited by examiner

*Primary Examiner* — Walter D Griffin
*Assistant Examiner* — Renee E Robinson
(74) *Attorney, Agent, or Firm* — James C Paschall

(57) ABSTRACT

One exemplary embodiment can be a fluid catalytic cracking unit. The fluid catalytic cracking unit can include a first riser, a second riser, and a disengagement zone. The first riser can be adapted to receive a first feed terminating at a first reaction vessel having a first volume. The second riser may be adapted to receive a second feed terminating at a second reaction vessel having a second volume. Generally, the first volume is greater than the second volume. What is more, the disengagement zone can be for receiving a first mixture including at least one catalyst and one or more products from the first reaction vessel, and a second mixture including at least one catalyst and one or more products from the second reaction vessel. Typically, the first mixture is isolated from the second mixture.

8 Claims, 5 Drawing Sheets

UNIT, SYSTEM AND PROCESS FOR CATALYTIC CRACKING

CROSS-REFERENCE TO RELATED APPLICATION

This application is a Division of application Ser. No. 12/333,262 filed Dec. 11, 2008, now U.S. Pat. No. 8,137,631, the contents of which are hereby incorporated by reference in its entirety.

FIELD OF THE INVENTION

This invention generally relates to a fluid catalytic cracking unit or system for producing, e.g., gasoline and light olefins, such as propylene.

DESCRIPTION OF THE RELATED ART

Generally, cracking processes are utilized to produce a variety of products. In one exemplary process, fluid catalytic cracking can convert heavy hydrocarbons into light hydrocarbons. Particularly, one preferred product is a high octane gasoline product that can be used for, e.g., motor fuels. In addition, it is also desirable to produce other products, such as ethylene and/or propylene. Such light olefins can be used in subsequent polymerization processes.

However, a fluid catalytic cracking system can produce undesirable side reactions that may reduce yields of some products, such as ethylene and propylene. Consequently, it would be desirable to provide a system that allows the simultaneous production of a gasoline product and a propylene product while minimizing undesirable side reactions that can reduce the yield of a desired product, such as propylene.

SUMMARY OF THE INVENTION

One exemplary embodiment can be a fluid catalytic cracking unit. The fluid catalytic cracking unit can include a first riser, a second riser, and a disengagement zone. The first riser can be adapted to receive a first feed terminating at a first reaction vessel having a first volume. The second riser may be adapted to receive a second feed terminating at a second reaction vessel having a second volume. Generally, the first volume is greater than the second volume. What is more, the disengagement zone can be for receiving a first mixture including at least one catalyst and one or more products from the first reaction vessel, and a second mixture including at least one catalyst and one or more products from the second reaction vessel. Typically, the first mixture is isolated from the second mixture.

Another exemplary embodiment can be a fluid catalytic cracking system. The system can include a first reaction zone receiving a first feed having a boiling point range of about 180° to about 800° C. The first reaction zone may include a first reaction vessel having a first volume. The system can also include a second reaction zone receiving a second feed including an effective amount of one or more $C_4$-$C_6$ olefins for producing propylene. The second reaction zone may include a second reaction vessel having a second volume. Generally, the first volume is greater than the second volume.

A further exemplary embodiment can be a process for producing gasoline and propylene. The process can include passing a first stream through a first reaction zone including a first reaction vessel having a first volume. Generally, the first stream has a boiling point range of about 180° to about 800° C. The process can also include passing a second stream through a second reaction zone including a second reaction vessel having a second volume. Typically, the second stream includes an effective amount of $C_4$-$C_6$ olefins for producing propylene. Generally, the first volume is greater than the second volume.

Thus, the embodiments disclosed herein can provide at least a unit and/or system that allows the simultaneous production of a gasoline product and a light olefin, such as propylene, while minimizing undesired side reactions. Generally, at least some of the embodiments disclosed herein can isolate the products while in the presence of catalyst that can facilitate undesirable side reactions in, e.g., a disengagement zone. Also, at least two reaction zones can be used with one reaction zone having conditions suitable for light olefin production.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated $C_1$, $C_2$, $C_3$ . . . $C_n$ where "n" represents the number of carbon atoms in the one or more hydrocarbon molecules.

As used herein, the term "rich" can mean an amount of generally at least about 50%, and preferably about 70%, by mole, of a compound or class of compounds in a stream.

DETAILED DESCRIPTION

Figure 1:
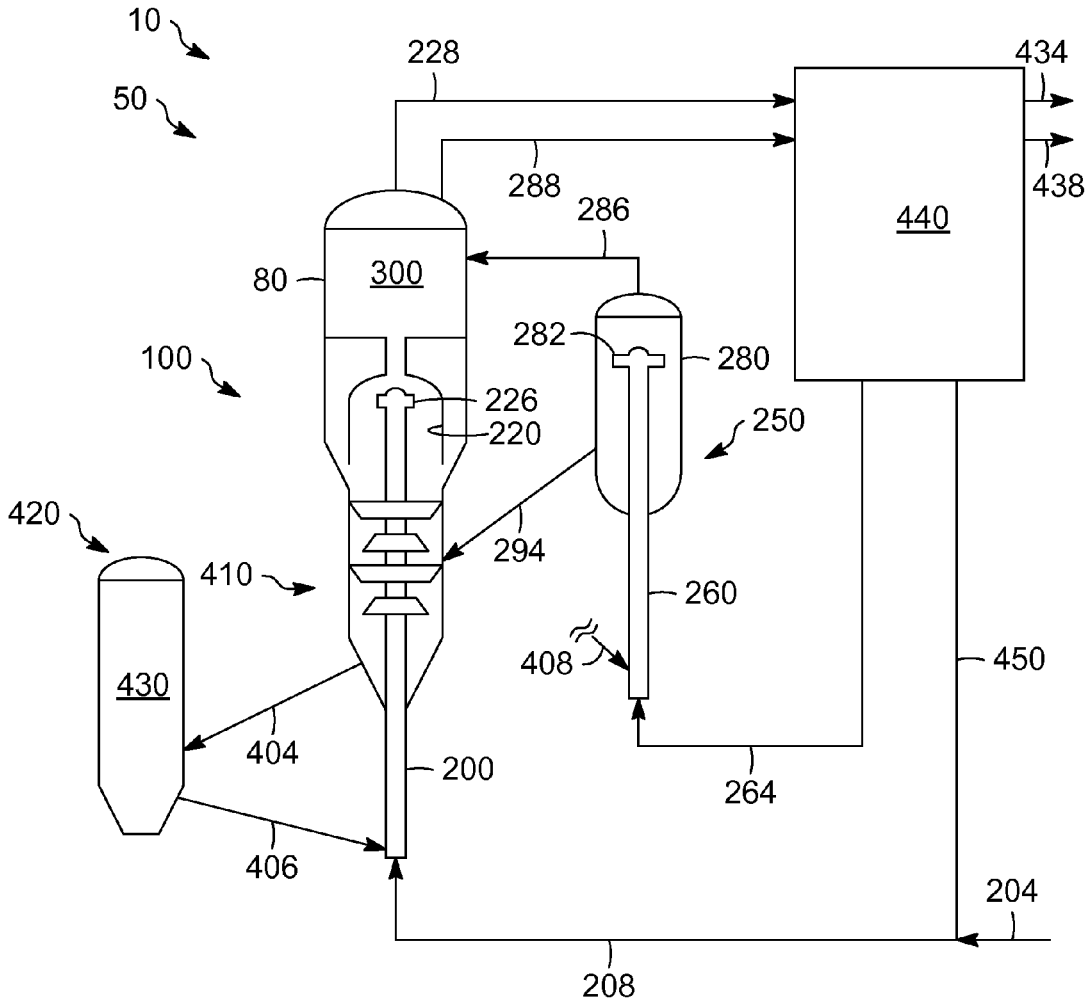
FIG. 1 is a schematic depiction of an exemplary fluid catalytic cracking system and unit.
Figure 2:
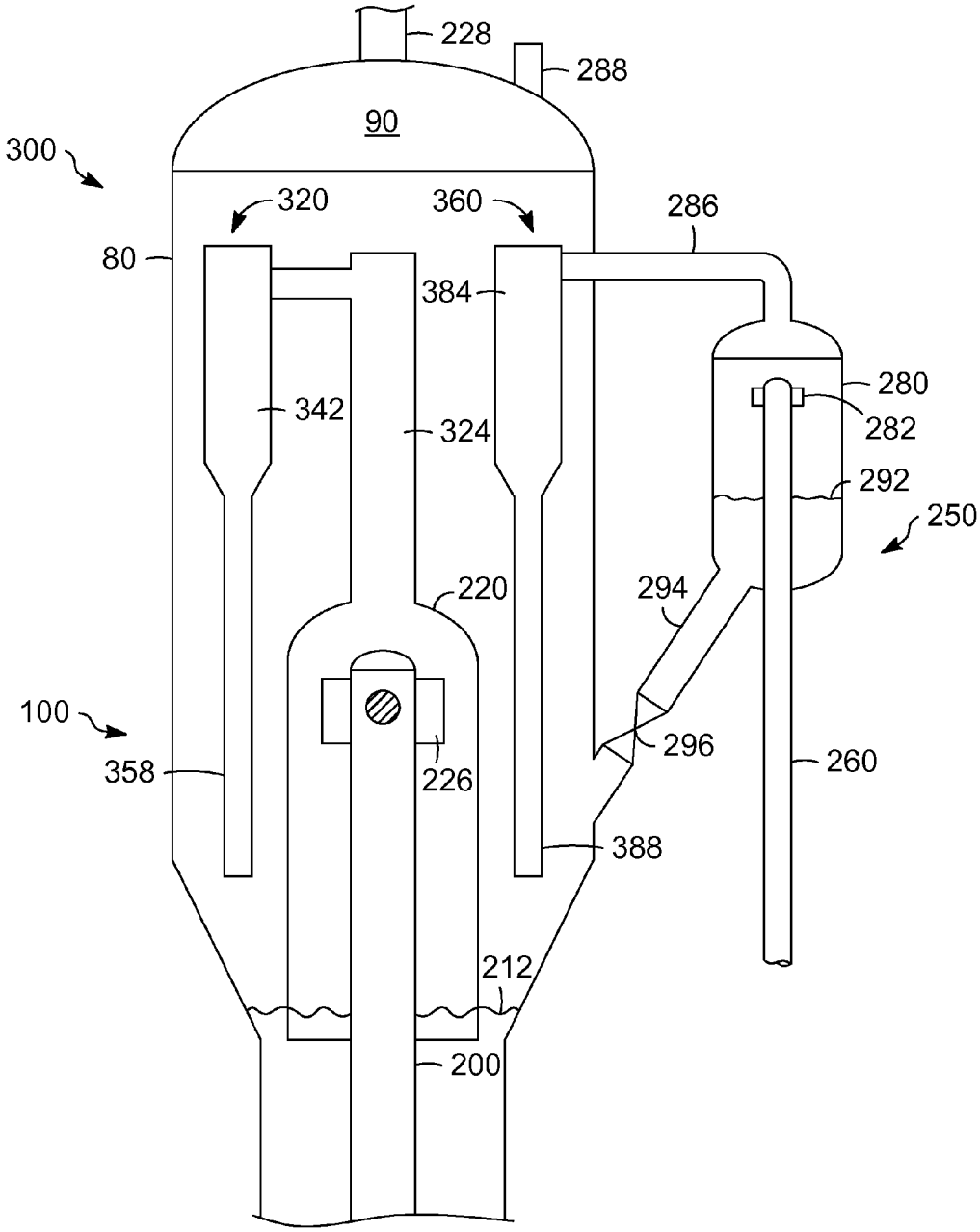
FIG. 2 is a schematic cross-sectional depiction of exemplary first and second reaction zones of the system and unit.

Referring to FIGS. 1-2, a fluid catalytic cracking (hereinafter may be abbreviated "FCC") system 10 or a fluid catalytic cracking unit 50 can include a first reaction zone 100, a second reaction zone 250, a stripping zone 410, a regeneration zone 420, and a separation zone 440. Generally, the first reaction zone 100 can include a first riser 200 terminating in a first reaction vessel 220. The first riser 200 can receive a first feed 208 that can include a hydrocarbon stream boiling in a range of about 180° to about 800° C. Particularly, the first feed 208 can include at least one of a gas oil, a vacuum gas oil, an atmospheric gas oil, a coker gas oil, a hydrotreated gas oil, a hydrocracker unconverted oil, and an atmospheric residue from a stream 204 and/or a stream 450, as hereinafter described. Moreover, process flow lines in the figures can be referred to interchangeably as, e.g., lines, pipes, conduits, feeds, mixtures, or streams. Particularly, a line, a pipe, or a conduit can contain one or more feeds, mixtures, or streams, and one or more feeds, mixtures, or streams can be contained by a line, a pipe, or a conduit.

Generally, the first feed 208 is fed into the bottom of the riser 200 where it is combined with a catalyst that can include two components. Such catalyst compositions are disclosed in, e.g., U.S. Pat. No. 7,312,370 B2. Typically, the first component may include any of the well-known catalysts that are used in the art of FCC, such as an active amorphous clay-type catalyst and/or a high activity, crystalline molecular sieve. Zeolites may be used as molecular sieves in FCC processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nm in effective diameter defined by greater than 10, and typically 12, member rings. Pore Size Indices of large pores can be above about 31. Suitable large pore zeolite components may include synthetic zeolites such as X and Y zeolites, mordent and faujasite. Y zeolites with a rare earth content of no more than about 1.0 weight percent (hereinafter may be abbreviated as "wt. %") rare earth oxide on the zeolite portion of the catalyst may be preferred as the first component.

The second component may include a medium or smaller pore zeolite catalyst exemplified by ZSM-5, ZSM-11, ZSM-12, ZSM-23, ZSM-35, ZSM-38, ZSM-48, and other similar materials. Other suitable medium or smaller pore zeolites include ferrierite, and erionite. The second component preferably has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10 to about 50 wt. % or more, and a matrix material content of about 50 to about 90 wt. %. Components containing about 40 wt. % crystalline zeolite material are preferred, and those with greater crystalline zeolite content may be used. Generally, medium and smaller pore zeolites are characterized by having an effective pore opening diameter of less than or equal to about 0.7 nm, rings of 10 or fewer members, and a Pore Size Index of less than 31.

The total mixture may contain about 1 to about 25 wt. % of the second component, namely a medium to small pore crystalline zeolite with greater than or equal to about 1.75 wt. % being preferred. When the second component contains about 40 wt. % crystalline zeolite with the balance being a binder material, the mixture may contain about 4 to about 40 wt. % of the second catalyst with a preferred content of at least about 7 wt. %. The first component may comprise the balance of the catalyst composition. Usually, the relative proportions of the first and second components in the mixture will not substantially vary throughout the FCC system 100. The high concentration of the medium or smaller pore zeolite as the second component of the catalyst mixture can improve selectivity to light olefins.

Generally, the first feed 208 and the catalyst mixture can be provided proximate to the bottom of the first riser 200. Typically, the first riser 200 operates with dilute phase conditions above the point of feed injection with a density that is less than about 320 kg/m$^3$. Generally, the first feed 208 is introduced into the first riser 200 by a nozzle. Usually, the first feed 208 has a temperature of about 140° to about 320° C. Moreover, additional amounts of feed may also be introduced downstream of the initial feed point. Any suitable fluidizing or lift gas, such as steam and/or a light hydrocarbon stream, may be utilized with the first feed 208.

In addition, the first reaction zone 100 can be operated at low hydrocarbon partial pressure in one desired embodiment. Generally, a low hydrocarbon partial pressure can facilitate the production of light olefins. Accordingly, the first riser 200 pressure can be about 170 to about 250 kPa with a hydrocarbon partial pressure of about 35 to about 180 kPa, preferably about 70 to about 140 kPa. A relatively low partial pressure for hydrocarbon may be achieved by using steam as a diluent, in the amount of about 10 to about 55 wt. %, preferably about 15 wt. % of the feed 208. Other diluents, such as dry gas, can be used to reach equivalent hydrocarbon partial pressures.

The one or more hydrocarbons and catalyst rise to the reaction vessel 220 converting the first feed 208. Usually, the feed 208 reacts within the first riser 200 to form one or more products. The first riser 200 can operate at any suitable temperature, and typically operates at a temperature of about 150° to about 430° C. Exemplary risers are disclosed in, e.g., U.S. Pat. No. 5,154,818 and U.S. Pat. No. 4,090,948.

The products can rise within the first riser 200 and exit within a first reaction vessel 220. Typically, products including propylene and gasoline are produced. Subsequently, the catalyst can separate assisted by a device, such as one or more swirl arms 226, and settle to the bottom of the first reaction vessel 220. In addition, a first mixture 324 including one or more products and any remaining entrained catalyst can rise into the disengagement zone 300 contained by a shell 80.

Generally, the first reaction vessel 220 forms a first volume. What is more, although the vessel 220 is described as a reaction vessel, it should be understood that other processes can also occur such as the separation of the catalyst and the hydrocarbons exiting the first riser 200. Particularly, although the catalyst is being separated from the hydrocarbons, some reactions still occur within the first reaction vessel 220.

Usually, the disengagement zone 300 can include separation devices, such as one or more cyclone separators as hereinafter described, for separating out the products from the catalyst particles. Dip legs can drop the catalyst down to the base of the shell 80 where openings can permit the entry of the spent catalyst into the first reaction vessel 220 to a dense catalyst bed 212. Exemplary separation devices and swirl arms are disclosed in, e.g., U.S. Pat. No. 7,312,370 B2.

The catalyst can pass through the stripping zone 410 where adsorbed hydrocarbons can be removed from the surface of the catalyst by counter-current contact with steam. An exemplary stripping zone is disclosed in, e.g., U.S. Pat. No. 7,312,370 B2. Afterwards, the catalyst can be regenerated, as discussed below.

The one or more products leaving the disengagement zone 300 can exit as a product stream through the line 228 to the separation zone 440. Generally, the separation zone 440 can receive the product stream 228 and another product stream 288, as hereinafter described, from the disengagement zone 300. Typically, the separation zone 440 can include one or more distillation columns. Such zones are disclosed in, for example, U.S. Pat. No. 3,470,084. Usually, the separation zone 440 can produce several products. As an example, a propylene product can exit via a line 434, a gasoline product can exit via a line 438, and a stream including $C_4$-$C_{10}$, preferably $C_4$-$C_6$, olefins can exit as a feed via a line 264. In this preferred embodiment, the stream can include primarily $C_4$-$C_6$ olefins and may be referenced accordingly. Particularly, various streams can be obtained depending on the columns in the separation zone 440. As an example, a $C_4$ draw can be obtained from the bottom of a $C_3$/$C_4$ splitter, a $C_5$-$C_6$ draw may be obtained from a debutanizer, and/or a $C_5$-$C_6$ overhead can be obtained from a high pressure naphtha splitter. Such streams can be provided as a second feed 264, as hereinafter described. In addition, the separation zone 440 can also provide a stream 450 comprising heavier fractions that can be recycled and included in the feed 208.

The stream 264 can be fed to the second reaction zone 250, which can include a second riser 260 terminating in a second reaction vessel 280. The stream 264 can include at least about 50%, by mole, of the components in a gas phase. Preferably, the entire stream 264, i.e., at least about 99%, by mole, is in a gas phase. Generally, the temperature of the stream 264 can be about 120° to about 500° C. when entering the second riser 260. Preferably, the temperature of the stream 264 is no less than about 320° C. Usually, the temperature of the stream 264 should be at least above the boiling point of the components with an upper limit being that of the catalyst. Usually, the second riser 260 can receive the same catalyst as the first riser 200, described above, via a conduit 408 that receives regenerated catalyst from the regeneration zone 420. The second riser 260 can operate at any suitable condition, such as a temperature of about 425° to about 705° C. and a pressure of about 40 to about 700 kPa. Typically, the residence time of the second riser 260 can be less than about 3 seconds, preferably less than about 1 second. Exemplary risers and/or operating conditions are disclosed in, e.g., US 2008/0035527 A1 and U.S. Pat. No. 7,261,807 B2. Usually, the stream 264 and catalyst can rise to the second reaction vessel 280 and pass through one or more swirl arms 282. In the second reaction vessel 280, the catalyst and hydrocarbon products can separate. The catalyst can drop to a dense catalyst bed 292 within the second reaction vessel 280. The catalyst from the second regeneration zone 250 can pass from a conduit 294 through a valve 296 to the stripping zone 410. Generally, the second reaction zone 250 may operate at conditions to convert the $C_4$-$C_6$ olefins into one or more light olefins, such as ethylene and/or propylene, preferably propylene.

Afterwards, a second mixture 286 including one or more products and entrained catalyst can exit the second reaction zone 250 and enter the disengagement zone 300, which will be described in further detail hereinafter. In one preferred embodiment, the propylene can be kept separated from the one or more products from the first reaction vessel 220 and exit via a line 288 to the separation zone 440.

The catalyst utilized in the first reaction zone 100 and second reaction zone 250 can be separated from the hydrocarbons. As such, the catalyst can settle into the stripping zone 410 and be subjected to stripping with steam, and subsequent regeneration.

Next, the stripped catalyst via a conduit 404 can enter the regeneration zone 420, which can include a regeneration vessel 430. The regeneration vessel 430 can be operated at any suitable conditions, such as a temperature of about 600° to about 800° C. and a pressure of about 160 to about 650 kPa. Exemplary regeneration vessels are disclosed in, e.g., U.S. Pat. No. 7,312,370 B2 and U.S. Pat. No. 7,247,233 B1. Afterwards, the regenerated catalyst can be provided to the first riser 200 and the second riser 260 by, respectively, conduits 406 and 408.

Figure 3:
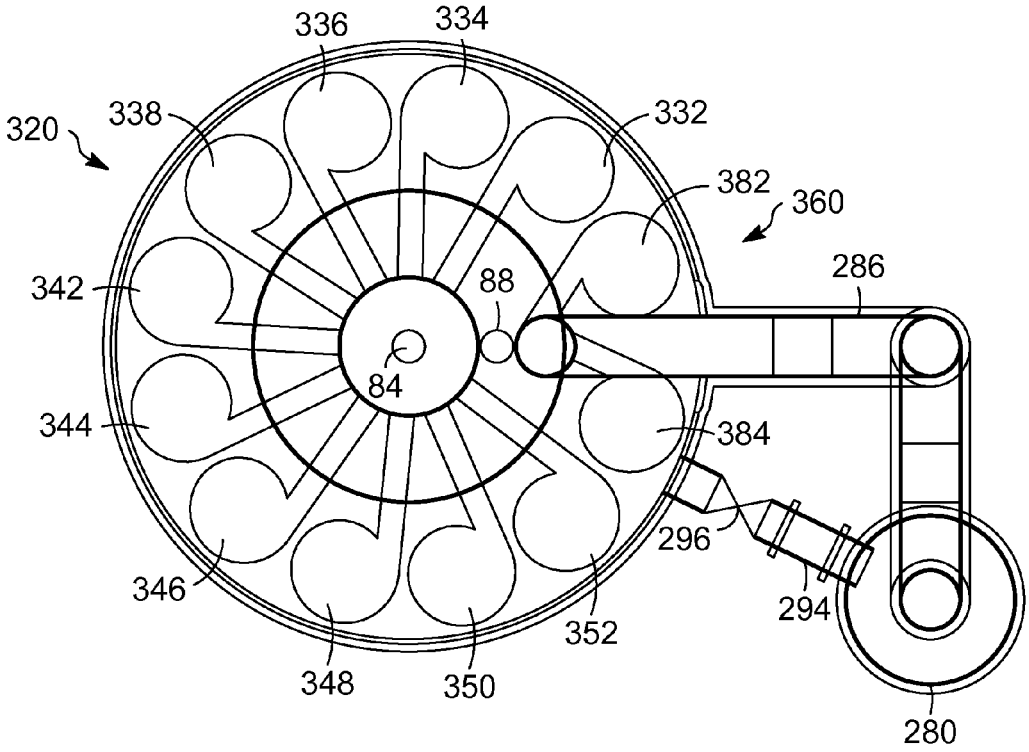
FIG. 3 is a schematic, top, and plan view of one exemplary disengagement zone.

Referring to FIGS. 2-3, the disengagement zone 300 can include a first cyclone separator unit 320 and a second cyclone separator unit 360. Although referred to as units 320 and 360, it should be understood that units 320 and 360 can also be considered zones or sub-zones 320 and 360. Particularly, the first mixture 324, including one or more products and entrained catalyst from the first reaction vessel 220, can rise upwards to the disengagement zone 300. In addition, the second mixture 286, including propylene and other products along with entrained catalyst from the second reaction vessel 280, can also be provided to the disengagement zone 300.

Referring to FIGS. 1-3, the disengagement zone 300 can include a first cyclone separator unit 320 having a plurality of cyclone separators, such as about 2 to about 60 cyclone separators. In this preferred embodiment, the first cyclone separator unit 320 can include cyclone separators 332, 334, 336, 338, 342, 344, 346, 348, 350, and 352. The first cyclone separator unit 320 can separate the one or more hydrocarbon products from the catalyst. Particularly, the first mixture 324 including the one or more hydrocarbon products, such as a gasoline product, and the catalyst can be provided to the first cyclone separator unit 320. As an example, the cyclone separator 342 can separate the catalyst and provide it via a dip leg 358 to the dense catalyst bed 212, and then to the stripping zone 410. The one or more hydrocarbon products can rise upwards via a first outlet 84 into a plenum 90 of the shell 80. In addition, the second cyclone separator unit 360 can receive the second mixture 286 including catalyst and one or more products, such as propylene. Typically, the propylene yield can be about 15 to about 20%, by weight, with respect to the total hydrocarbon weight, although the propylene yield can be any amount. It should be understood that other hydrocarbons may be present, such as methane and ethylene, as well as heavier hydrocarbons such as butene and pentene. The second cyclone separator unit 360 can include about 1 to about 30 cyclone separators. In this exemplary embodiment the second cyclone separator unit 360 can include a first cyclone separator 382 and a second cyclone separator 384. The second mixture 286 can enter the second cyclone separator unit 360 and the catalyst can be separated and provided to a dip leg 388 to return the catalyst to the stripping zone 410. Thus, the first mixture 324 can be isolated from the second mixture 286.

The propylene product can rise upwards via a second outlet 88 into the plenum 90 and optionally be kept separate from the one or more products from the first reaction vessel 220, which are often a gasoline product. As such, the gasoline product can be provided via a line 228 and the propylene product can be provided via a line 288. Alternatively, the propylene product and the gasoline product can be combined in the plenum 90 and provided via a single line to the separation zone 440. Generally, it is preferred to keep the gasoline and propylene products separate in the presence of the catalyst to prevent undesired side reactions. In addition, paraffins may be recycled within the system 10. Thus, separating the products 228 and 288 can prevent paraffins from accumulating within the second feed 264. Although the feeds 208 and 264 are depicted entering the bottom of respective risers 200 and 260, it should be understood a feed can be provided at any height along the riser 200 and/or 260.

Figure 4:
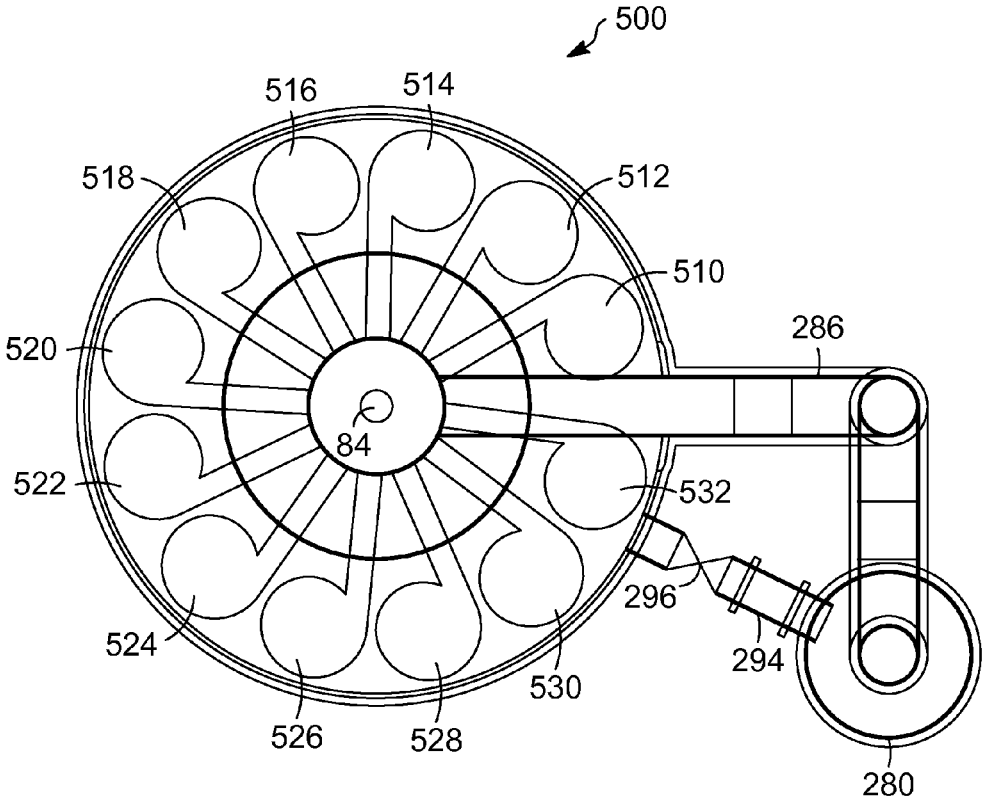
FIG. 4 is a schematic, top, and plan view of another exemplary disengagement zone.

In a further embodiment referring to FIG. 4, the disengagement zone can be a disengagement zone 500 that includes one or more cyclone separators, namely cyclone separators 510, 512, 514, 516, 518, 520, 522, 524, 526, 528, 530, and 532. In this exemplary embodiment, the propylene product can be provided via the conduit 286 and be combined with the gasoline product in the disengagement zone 500. In particular, the first mixture 324 including the gasoline product and the catalyst can be combined with the second mixture 286 including the propylene product and the catalyst in the disengagement zone 500. Thus, the mixtures can be combined and the products can mix freely with the catalyst.

Figure 5:
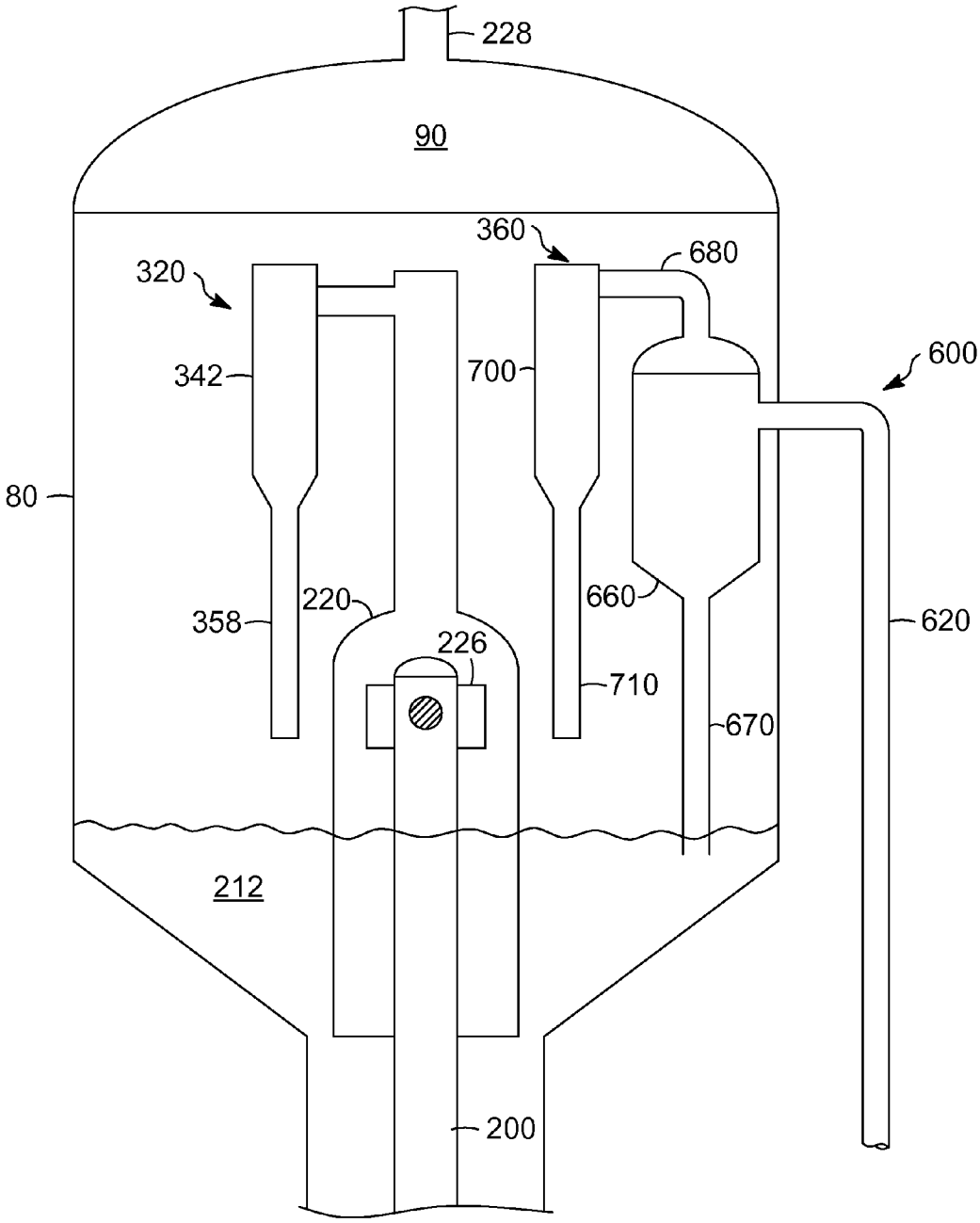
FIG. 5 is a schematic depiction of another exemplary reaction zone.

Referring to FIG. 5, yet another exemplary embodiment of a second reaction zone 600 is provided. In this exemplary embodiment, a riser 620 outside the shell 80 terminates in a reaction vessel 660 housed within the shell 80. As such, the first reaction vessel 220 and the second reaction vessel 660 are contained within the common shell 80. Catalyst can be provided to the riser 620 along with a feed stream of C4-C6 olefins, which are then provided to the second reaction vessel 660, as described above. A conduit 680 can provide a propylene product and catalyst to the second cyclone separator unit 360 where at least some of the catalyst can pass through a conduit 670 to the dense catalyst bed 212. In this exemplary embodiment, the second cyclone separator unit 360 can include a cyclone separator 700 with a dip leg 710. As described above, the catalyst can be separated and provided via the dip leg 710 to the dense catalyst bed 212, which then can be transferred to the stripping zone 410 for subsequent regeneration, as described above. The products can be combined in the plenum 90 and exit a single line 228. In another preferred embodiment, the one or more hydrocarbons separated from their respective catalyst can be isolated from each other and issue through separate product lines, as discussed above.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing gasoline and propylene, comprising:

A) passing a first stream through a first reaction zone comprising a first riser and a first reaction vessel having a first volume wherein the first stream has a boiling point range of about 180° to about 800° C.;

B) passing a second stream through a second reaction zone comprising a second riser and a second reaction vessel having a second volume wherein the second stream comprises an effective amount of $C_4$-$C_6$ olefins for producing propylene; wherein the first volume is greater than the second volume; and C) receiving a first mixture comprising at least one catalyst and one or more products from the first reaction zone, and a second mixture comprising at least one catalyst and one or more products from the second reaction zone in a disengagement zone contained by a shell.

2. The process according to claim 1, further comprising:

passing one or more products from the first reaction vessel to a separation zone; and recycling a stream comprised in the second stream wherein the recycled stream comprises an effective amount of $C_4$-$C_6$ olefins for producing propylene.

3. The process according to claim 1, wherein the first reaction zone is adapted to receive a first feed comprising at least one of a gas oil, a vacuum gas oil, an atmospheric gas oil, a coker gas oil, a hydrotreated gas oil, a hydrocracker unconverted oil, and an atmospheric residue.

4. The process according to claim 3, wherein the one or more products from the second reaction zone is rich in propylene.

5. A process for producing gasoline and propylene, comprising:

A) passing a first stream through a first reaction zone comprising a first riser and a first reaction vessel having a first volume wherein the first stream has a boiling point range of about 180° to about 800° C.;

B) passing a second stream through a second reaction zone comprising a second riser and a second reaction vessel having a second volume wherein the second stream comprises an effective amount of $C_4$-$C_6$ olefins for producing propylene; wherein the first volume is greater than the second volume; and C) receiving a first mixture comprising at least one catalyst and one or more products from the first reaction zone, and a second mixture comprising at least one catalyst and one or more products from the second reaction zone in a disengagement zone contained by a shell;

wherein the first mixture is isolated from the second mixture.

6. The process according to claim 5, further comprising:

passing one or more products from the first reaction vessel to a separation zone; and recycling a stream comprised in the second stream wherein the recycled stream comprises an effective amount of $C_4$-$C_6$ olefins for producing propylene.

7. The process according to claim 5, wherein the first reaction zone is adapted to receive a first feed comprising at least one of a gas oil, a vacuum gas oil, an atmospheric gas oil, a coker gas oil, a hydrotreated gas oil, a hydrocracker unconverted oil, and an atmospheric residue.

8. The process according to claim 7, wherein the one or more products from the second reaction zone is rich in propylene.

* * * * *